US008167420B2

(12) United States Patent
Hibi

(10) Patent No.: US 8,167,420 B2
(45) Date of Patent: May 1, 2012

(54) LIQUID DISCHARGING HEAD AND METHOD FOR MANUFACTURING THE SAME

(75) Inventor: Manabu Hibi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 128 days.

(21) Appl. No.: 12/412,224

(22) Filed: Mar. 26, 2009

(65) Prior Publication Data

US 2009/0244228 A1 Oct. 1, 2009

(30) Foreign Application Priority Data

Mar. 31, 2008 (JP) ..... 2008-091741

(51) Int. Cl.
*B41J 2/17* (2006.01)

(52) U.S. Cl. ..... 347/94; 347/68; 347/70

(58) Field of Classification Search ..... 347/94, 347/6, 7, 68–72
See application file for complete search history.

(56) References Cited

U.S. PATENT DOCUMENTS

| | | | | |
|---|---|---|---|---|
| 4,121,837 | A * | 10/1978 | Tominari et al. | 369/247.1 |
| 5,074,086 | A * | 12/1991 | Noji et al. | 52/167.2 |
| 5,545,461 | A * | 8/1996 | Takeuchi et al. | 428/138 |
| 5,943,079 | A * | 8/1999 | Yoshida | 347/94 |
| 6,945,636 | B2 | 9/2005 | Sakaida et al. | |
| 7,766,460 | B2 * | 8/2010 | Sekiguchi | 347/68 |
| 2006/0023034 | A1 * | 2/2006 | Ito et al. | 347/71 |
| 2006/0082619 | A1 | 4/2006 | Yasui | |
| 2006/0268075 | A1 * | 11/2006 | Sugahara et al. | 347/68 |
| 2007/0091145 | A1 * | 4/2007 | Takahashi et al. | 347/54 |
| 2007/0109373 | A1 | 5/2007 | Kojima | |
| 2008/0165228 | A1 * | 7/2008 | Kang et al. | 347/68 |

FOREIGN PATENT DOCUMENTS

| | | | |
|---|---|---|---|
| EP | 1780018 | A1 | 5/2007 |
| EP | 1964681 | A2 | 9/2008 |
| JP | 2003-063017 | A | 3/2003 |
| JP | 2003-311958 | A | 11/2003 |
| JP | 2006-062260 | A | 3/2006 |
| JP | 2006-093348 | A | 4/2006 |
| JP | 2006-218776 | A | 8/2006 |

(Continued)

OTHER PUBLICATIONS

European Patent Office; European Search Report in Application No. EP 09004372 (counterpart to the above-captioned U.S. patent application) mailed Aug. 20, 2009.

(Continued)

*Primary Examiner* — Matthew Luu
*Assistant Examiner* — Henok Legesse
(74) *Attorney, Agent, or Firm* — Baker Botts L.L.P.

(57) ABSTRACT

A liquid discharging head is provided. The liquid discharging head has a flow path unit in which a common liquid flow path for supplying liquid to a nozzle which discharges liquid is formed by a plurality of plates being stacked together, the plurality of plates including a damper plate of which one surface defines at least a part of a wall surface of the common liquid flow path and an area on an other surface which is opposed to the common liquid flow path across the damper plate is not in contact with the plurality of plates other than the damper plate, wherein compression stress along the wall surface is applied to a portion of the damper plate which configure a wall of the common liquid flow path.

8 Claims, 9 Drawing Sheets

FOREIGN PATENT DOCUMENTS

JP 2006-327031 A 12/2006

OTHER PUBLICATIONS

Michael F. Ashby & David R. H. Jones, An Introduction to Microstructures, Processing and Design, Engineering Materials 2, 1986, pp. 150-151, 39 International Series on Materials Science and Technology, Pergamon.

S. M. SZE, Physics of Semiconductor Devices, 1981, p. 851, John Wiley & Sons, Inc.

* cited by examiner

LIQUID DISCHARGING HEAD AND METHOD FOR MANUFACTURING THE SAME

CROSS REFERENCE TO RELATED APPLICATION

The present application claims priority from Japanese Patent Application No. 2008-091741, which was filed on Mar. 31, 2008, the disclosure of which is herein incorporated by reference in its entirety.

TECHNICAL FIELD

The present invention relates to a liquid discharging head and a method for manufacturing the same.

BACKGROUND

A known inkjet head for discharging droplets of ink includes a flow path unit in which a common ink chamber having a plurality of manifold flow paths, a plurality of individual ink flow paths reaching nozzles from outlets of the respective manifold flow paths via pressure chambers and damper chambers which lie adjacent to the common ink chamber via a damper plate. This flow path unit has a stacked construction in which a plurality of metallic plates are stacked together. By damper portions which are configured by thin portions of the damper plate which configures a bottom wall of the common ink chamber being deformed elastically, pressure fluctuation in ink stored in the common ink chamber is suppressed, whereby the ink discharging properties of the inkjet head are stabilized.

SUMMARY

In the above inkjet head, from the viewpoint of enhancing the damper effect, the natural frequency of the damper portions, in other words, the rigidity of the damper portions are preferably decreased. Then, it is considered to decrease the rigidity of the damper portions by decreasing the thickness of the damper portions. However, since the damper portions are elastically deformed in a repeated fashion, in the event that the thickness of the damper portions is decreased too much, the durability of the damper portions is decreased remarkably.

Accordingly, it is an object of the invention to provide a liquid discharging head which can enhance the damper effect with respect to common liquid flow paths while ensuring the thickness of a damper plate and a manufacturing method of the liquid discharging head.

According to the present invention, there is provided a liquid discharging head comprising: a flow path unit in which a common liquid flow path for supplying liquid to a nozzle which discharges liquid is formed by a plurality of plates being stacked together, the plurality of plates including a damper plate of which one surface defines at least a part of a wall surface of the common liquid flow path and an area on an other surface which is opposed to the common liquid flow path across the damper plate is not in contact with the plurality of plates other than the damper plate, wherein compression stress along the wall surface is applied to a portion of the damper plate which configure a wall of the common liquid flow path.

According to the aspect of the invention, since when the compression stress is applied to the portion of the damper plate which confronts the common liquid flow path, the natural frequency of the portion is decreased due to stress softening, the damper effect with respect to the common liquid flow path can be increased while ensuring the thickness of the portion of the damper plate which confront the common liquid flow path.

According to another aspect of the invention, there is provided a method for manufacturing a liquid discharging head which comprises a flow path unit in which a common liquid flow path for supplying liquid to a nozzle which discharges liquid is formed by a plurality of plates made of a metallic material being stacked together, the plurality of plates including a damper plate of which one surface defines at least a part of a wall surface of the common liquid flow path and an area on an other surface which is opposed to the common liquid flow path across the damper plate is not in contact with the plurality of plates other than the damper plate, the method comprising: a plate forming step of forming the plurality of plates; and a joining step of joining the plates which are adjacent to each other in such a state that the plates are heated, wherein in the plate forming step, the damper plate is formed of a metallic material having a coefficient of linear expansion along the wall surface which is smaller than that of the plate which is adjacent to the damper plate.

According to the above method, since the damper plate is made of the material having the smaller coefficient of linear expansion than the other plates, in the joining step, when the damper plate and the other plates joined thereto are cooled from the heated state, by the other plates joined thereto attempting to contract more largely than the damper plate, compression stress is applied to the portion of the damper plate which confront the common liquid flow path. Because of this, since the natural frequency of the portion is decreased due to stress softening, the damper effect with respect to the common liquid flow path can be enhanced while ensuring the thickness of the portion of the damper plate which confronts the common liquid flow path.

BRIEF DESCRIPTION OF THE DRAWINGS

Illustrative aspects of the invention will be described in detail with reference to the following figures wherein.

DETAILED DESCRIPTION OF EXEMPLARY EMBODIMENTS OF THE PRESENT INVENTION

Hereinafter, an exemplary embodiment of the invention will be described by reference to the accompanying drawings.

Figure 1:
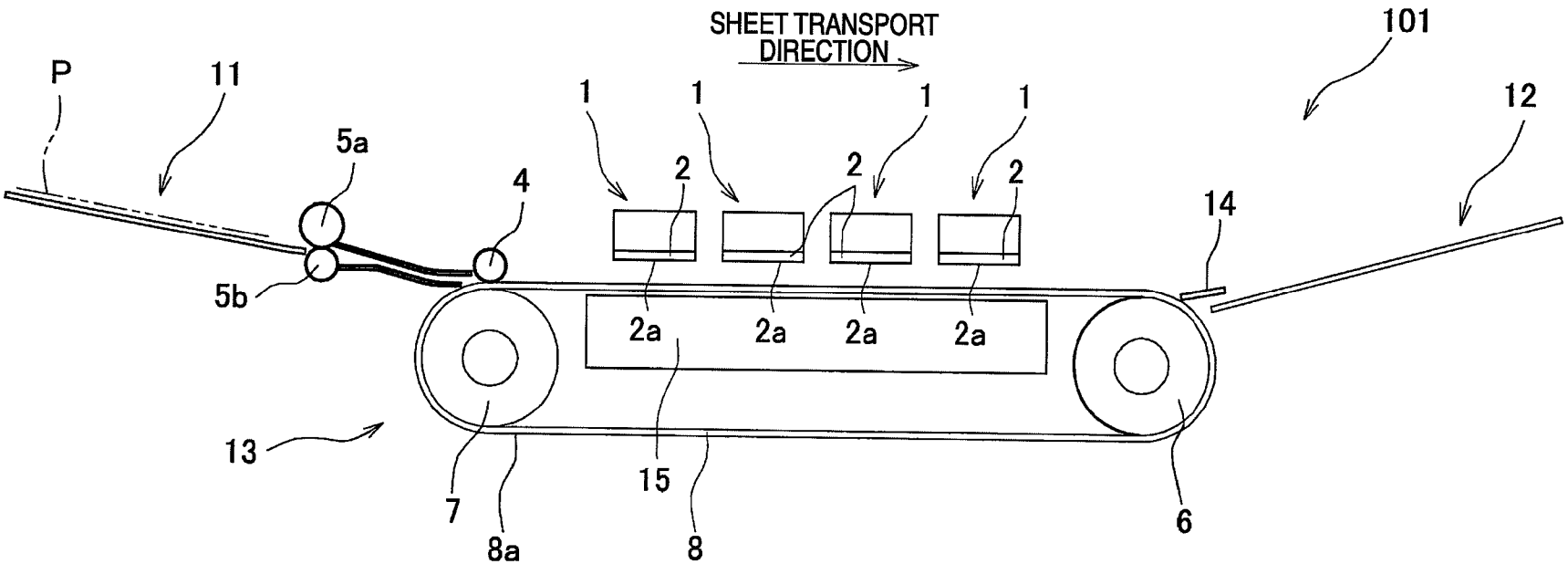
FIG. 1 is an external side view of an inkjet printer having inkjet head according to an exemplary embodiment of the invention.

FIG. 1 is a schematic side view showing an overall configuration of an inkjet printer having an inkjet head of an exemplary embodiment according to the present invention. As shown in FIG. 1, an inkjet printer 101 is a color inkjet printer having four inkjet heads 1. This inkjet printer 101 includes a sheet feeding unit 11, which is disposed on a left-hand side, and a sheet discharging unit 12, which is disposed on a right-hand side of the inkjet printer 101 as viewed in the figure.

A sheet transport path is formed in an interior of the inkjet printer 101, and a sheet P is transported from the sheet feeding unit 11 towards the sheet discharging unit 12 along the sheet transport path so formed. A pair of forwarding rollers 5*a*, 5*b* is disposed directly downstream of the sheet feeding unit 11, and the sheet P is held and transported downstream by the pair of forwarding rollers 5*a*, 5*b* so disposed. The pair of forwarding rollers 5*a*, 5*b* is provided for sending the sheet P to the right in the figure. A transport mechanism 13 is provided in a middle portion of the sheet transport path. This transport mechanism 13 includes two belt rollers 6, 7, an endless transport belt 8 which is looped around the two belt rollers 6, 7 so as to be extended therebetween and a platen 15 which is disposed within an area surrounded by the transport belt 8. The platen 15 is provided for supporting the transport belt 8 in a position which confronts the inkjet heads 1 so as to prevent a downward deflection of the transport belt 8. A nip roller 4 is disposed in a position which confronts the belt roller 7. The nip roller 4 is provided for pressing a sheet P which is fed out of the sheet feeding unit 11 by the forwarding rollers 5*a*, 5*b* against an outer circumferential surface 8*a* of the transport belt 8.

By a transport motor, rotating the belt roller 6, the transport belt 8 is caused to run in a circle. By this action, the transport belt 8 transports the sheet P pressed against the outer circumferential surface 8*a* by the nip roller 4 towards the sheet discharging unit 12 while holding the sheet P thereon in an adhesive fashion. In addition, a silicone resin layer having weak adhesion is formed on the surface of the transport belt 8.

A separation plate 14 is provided directly downstream of the transport belt 8. The separation plate 14 is configured so as to separate the sheet P adhering to the outer circumferential surface 8*a* of the transport belt 8 from the outer circumferential surface 8*a*, so as to guide the sheet P towards the sheet discharging unit 2 lying on a right-hand side thereof as viewed in the figure.

The four inkjet heads 1 are aligned in a sheet transport direction so as to correspond to inks of four colors (magenta, yellow, cyan, black). Namely, this inkjet printer 101 is an in-line printer. Each inkjet head 1 has a head main body 2 at a lower end thereof. The head main body 2 has a rectangular parallelepiped shape which is elongated in a direction which is at right angles to the transport direction. In addition, a bottom surface of the head main body 2 constitutes an ink discharge surface 2*a* which confronts the outer circumferential surface 8*a* of the transport belt 8. When the sheet P which is being transported by the transport belt 8 sequentially pass just by lower sides of the four head main bodies 2, inks of the respective colors are discharged towards an upper surface, that is, a printing surface of the sheet P to thereby print a desired color image on the printing surface of the sheet P.

Figure 2:
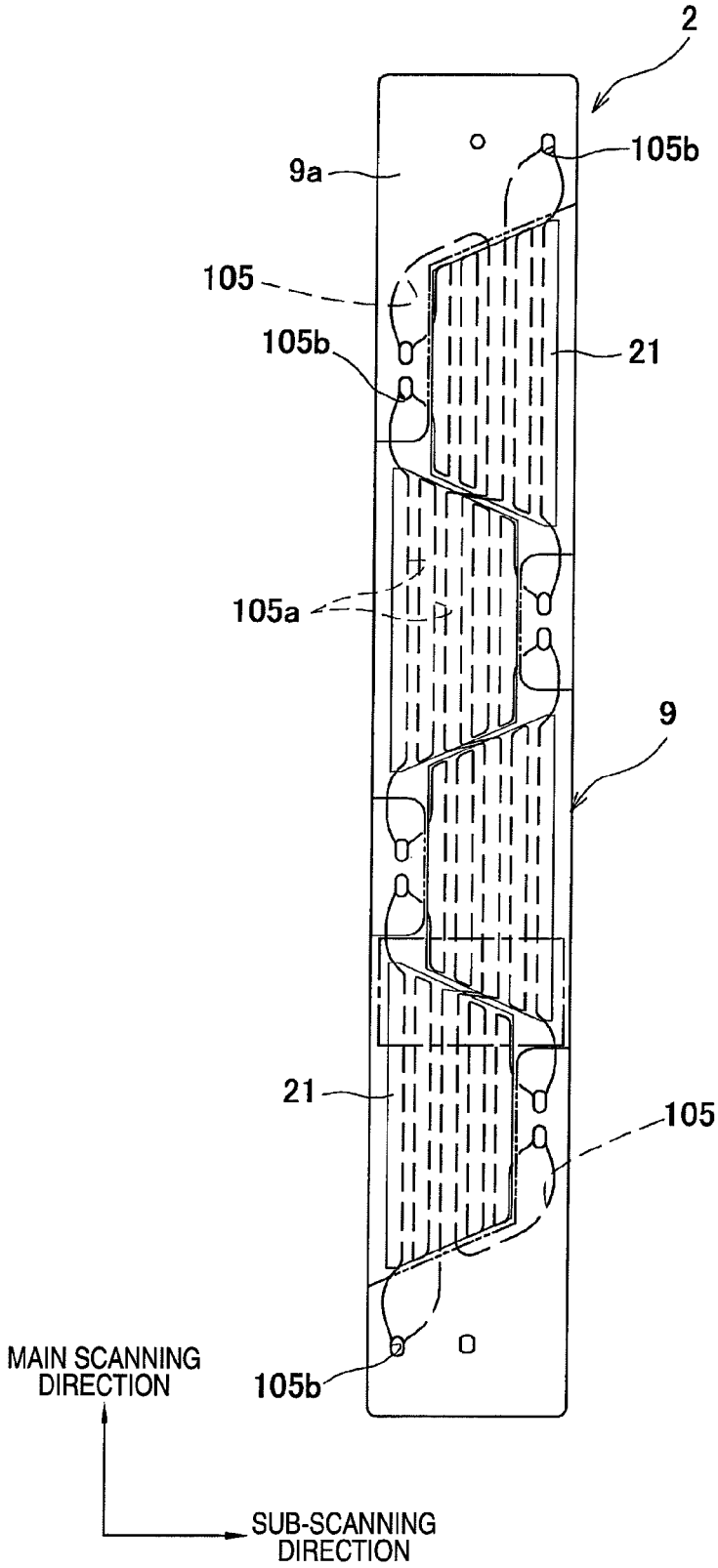
FIG. 2 is a plan view of a head main body shown in FIG. 1.
Figure 3:
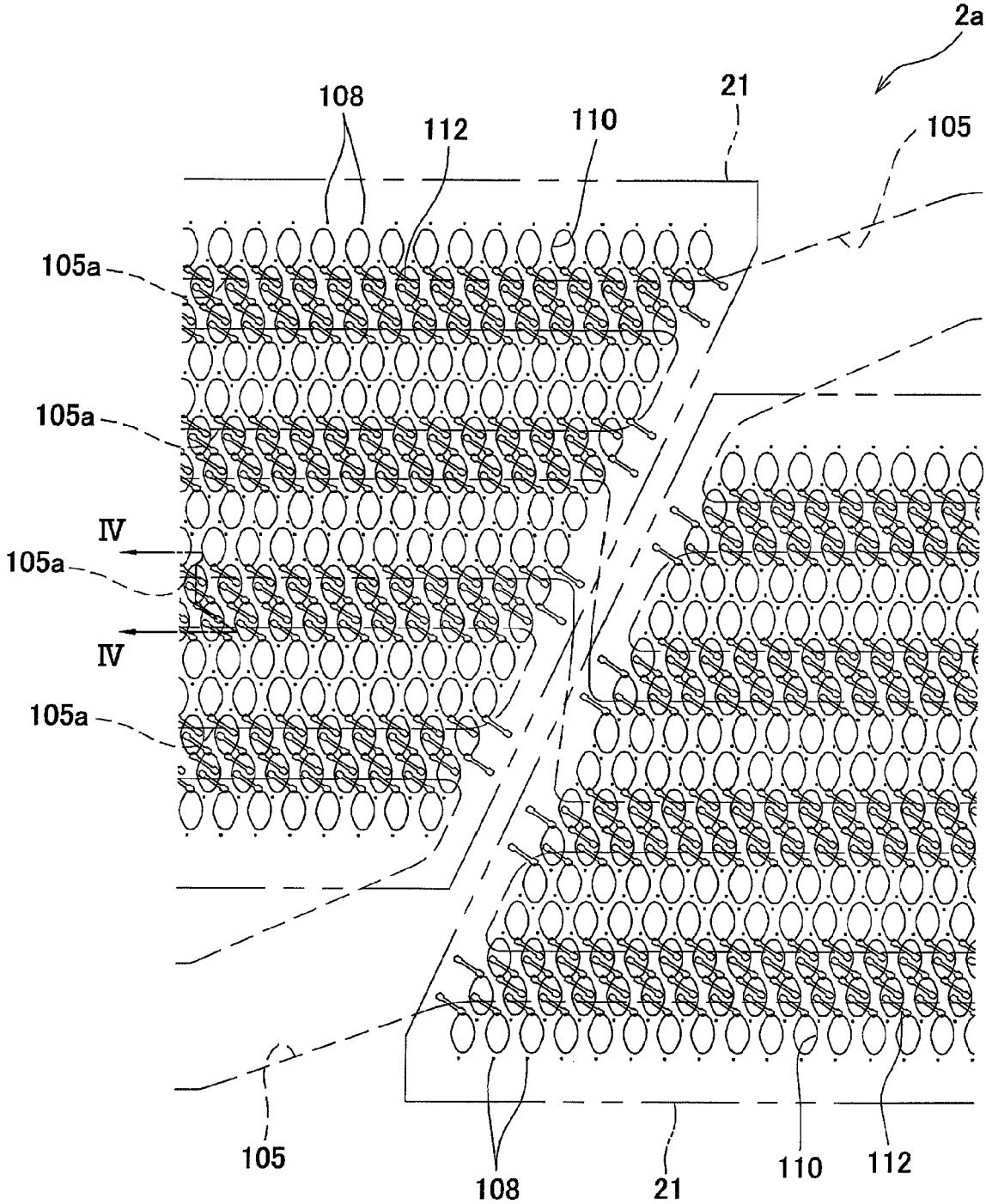
FIG. 3 is an enlarge view of an area surrounded by alternate long and short dash lines in FIG. 2.
Figure 4:
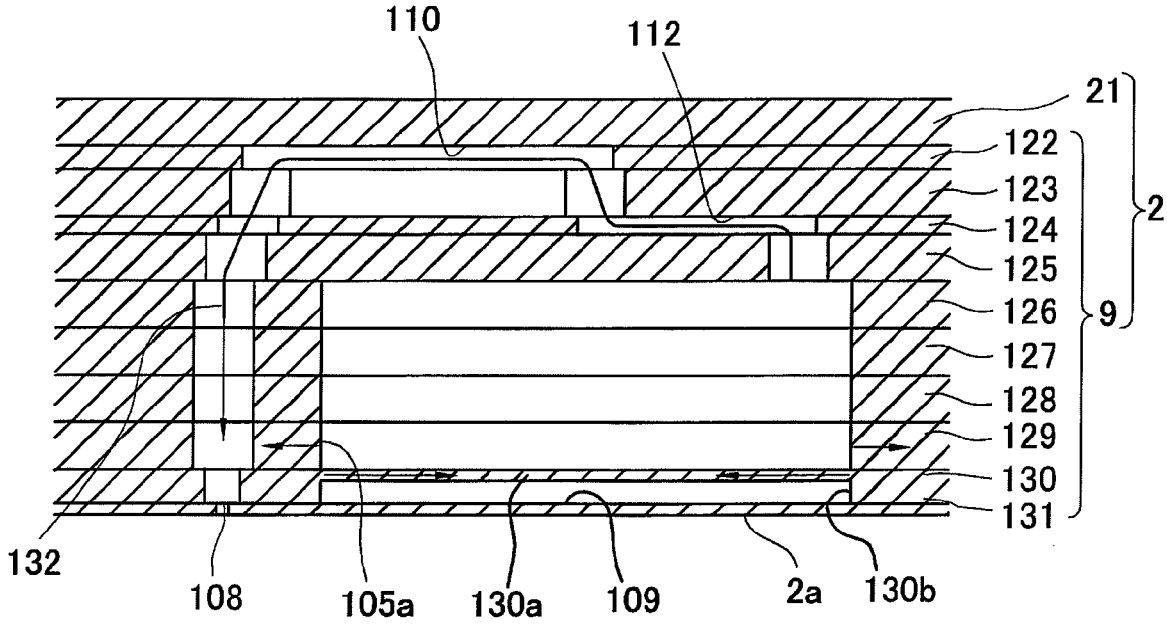
FIG. 4 is a sectional view taken along the line IV-IV shown in FIG. 3.

Next, referring to FIGS. 2 to 4, the head main body 2 will be described. FIG. 2 is a plan view of the head main body 2. FIG. 3 is an enlarged view of an area surrounded by an alternate long and short dash line in FIG. 2. In addition, as a matter of conveniences in illustration, pressure chambers 110, apertures 112 and nozzles 108 which are situated at lower portions in actuators 21 and, hence, should have been drawn by broken lines are drawn by solid lines. FIG. 4 is a partial sectional view taken along the line IV-IV shown in FIG. 3.

The head main body 2 makes up the inkjet head 1 by a driver IC for generating drive signals for driving actuator units 21, and a reservoir unit which supplies some of ink from an ink tank to a flow path unit 9 while storing therein other ink being built therein.

As shown in FIG. 2, in the head main body 2, four actuator units 21 are fixed to an upper surface 9*a* of the flow path unit 9. As shown in FIG. 3, in the flow path unit 9, ink flow paths including pressure chambers 110 are formed in an interior thereof. The actuator unit 21 includes a plurality of actuators which correspond to the pressure chambers 110 individually and functions to selectively give discharging energy to ink in the pressure chambers 110 by the actuators being driven by the driver IC.

The flow path unit 9 has a rectangular parallelepiped shape. 10 ink supply ports in total are opened in the upper surface 9*a* of the flow path unit 9 in such a way as to correspond to ink outlet ports of the reservoir unit. As shown in FIGS. 2 and 3, two manifold flow paths 105 are formed in the interior of the flow path unit 9, each manifold flow path being made to communicate with the five ink supply ports 105*b* which are arranged in a longitudinal direction (a main scanning direction) of the flow path unit 9 in the vicinity of end portions with respect to a transverse direction (a sub-scanning direction) of the flow path unit 9. In addition, each manifold flow path 105 has a plurality of sub-manifold flow paths 105*a* which branch off in such a manner as to be parallel to each other and to extend in the main scanning direction.

An ink discharge surface 2*a* is formed on a lower surface of the flow path unit 9, and a large number of nozzles 108 are disposed in a matrix fashion on the ink discharge surface 2*a*. The pressure chambers 110 are also arranged in a large number and in a similar matrix fashion to that of the nozzles 108 in a surface to which the actuators 21 are fixed.

In this exemplary embodiment, 16 rows of pressure chambers 110 are arranged parallel to each other in the transverse direction of the flow path unit 9, each row including pressure chambers 110 aligned at equal intervals in the longitudinal direction of the flow path unit 9. The numbers of pressure chambers 110 in the respective pressure chamber rows correspond to an external shape (a trapezoidal shape) of the actuator unit 21, which will be described later, and the rows of pressure chambers are arranged in such a manner that the numbers of pressure chambers in the rows decrease gradually from a longer side toward a shorter side of the trapezoidal shape. The nozzles 108 are also arranged in a similar way.

Further, as shown in FIG. 4, in the flow path unit 9, damper chambers 109 are formed so as to lie adjacent to the sub-manifold flow paths 105*a* via damper portions 130*a* while extending in the direction in which the sub-manifold flow path 105*a* extend. By the damper portions 130*a* being deformed elastically, pressure fluctuation in ink stored within the sub-manifold flow paths 105*a* is suppressed, thereby making it possible to stabilize the discharging properties of ink droplets.

The flow path unit 9 includes 10 plates 122 to 131 which are made of a stainless steel and are joined to one another through metal welding or metal joining (solid-state joining). The plates 122 to 131 each have a rectangular flat surface which is elongated in the main scanning direction. Of these plates 122 to 131, nine plates 122 to 129, 131 excluding the damper plate 130 are formed of a SUS 316 stainless steel, while the damper plate 130 is formed of a SUS 430 stainless steel. Here, the coefficient of linear expansion of SUS 316 is $16.0\times10^{-6}$/C°, and the coefficient of linear expansion of SUS 430 is $10.4\times10^{-6}$/C°. Namely, the coefficient of linear expansion of the damper late 130 is smaller than that of the other plates.

Here, the damper plate 130 will be described in detail. A recessed portion 130*b* is formed on a lower surface of the damper plate 130 so as to be opened towards the nozzle plate 131 which lies adjacent to the lower surface of the damper plate 130. The damper chamber 109 is defined by the recessed portion 130*b* formed on the damper plate 130 and the nozzle plate 131. A bottom wall of the recessed portion 130*b* formed on the damper plate 130 is a bottom wall of the sub-manifold flow path 105*a* and configures a damper portion 130*a* which absorbs pressure fluctuation in ink. In this way, in the damper plate 130, an upper surface defines the bottom wall (bottom surface) of the sub-manifold flow path 105*a*, while a lower surface of the damper portion 130*a* is not in contact with the nozzle plate 131 which lies adjacent to the lower surface of the damper plate 130.

In addition, compression stress which follows along the surface of the damper portion 130*a* is applied to the damper portion 130*a*. In contrast with this, tensile stress which follows along the surface of the damper portion 130*a* is applied to the manifold plate 129 which lies on the damper plate 130 at a joining portion between the manifold plate 129 and the damper plate 130 (refer to arrows). In addition, the compression stress applied to the damper portion 130*a* and the tensile stress applied to the manifold plate 129 are, as will be described later, generated by the plates 122 to 129, 131 (not including the damper plate 130) attempting to contract than the damper plate 130.

From the viewpoint of enhancing the damper effect with respect to the sub-manifold flow path 105*a*, the natural frequency f of the damper portion 130*a* is preferably low. A resonant body exhibits a phenomenon in which its natural frequency f changes when an external force is applied thereto. It is said that an initial stress is generated in an interior of the resonant body by the external force and the apparent modulus of elasticity changes. Actually, the natural frequency f is decreased in the damper portion 130*a* due to the compression stress which follows the surface thereof. Here, the natural frequency f of a member decreases as the compliance of the member increases as shown in $$f\propto(1/\rho\cdot C)^{1/2},$$

where ρ denotes the density of the member and C denotes the compliance (pliability) thereof. In addition, when compression stress is applied to the member, the member is stress softened and its apparent compliance increases. Namely, since the compression stress is applied to the damper portion 130*a*, the natural frequency f of the damper portion 130*a* is decreased. By this fact, compared with a case where no compression stress is applied to the damper portion 130*a*, the damper effect with respect to the sub-manifold flow path 105*a* is increased. It can be said that due to this, the thickness of the damper portion 130*a* is in effect reduced.

Through holes formed in the plates 122 to 131 are connected for communication by these plates 122 to 131 being stacked while being aligned with each other, whereby the two manifold flow paths 105, the large number of individual ink flow paths 132 reaching the corresponding nozzles 108 from the supply ports 125*a* which configure the outlets of the sub-manifold flow paths 105*a* which are related to the respective manifold flow paths 105 via the pressure chambers 110, and the damper chambers 109 are formed.

The flow of ink in the flow path unit 9 will be described. Ink that is supplied from the reservoir unit into the flow path unit 9 via the ink supply ports 105*b* divides into the sub-manifold paths 105*a* in the manifold flow paths 105. Ink in the sub-manifold flow path 105*a* flows into the individual ink flow paths 132 and reaches the nozzles 108 via apertures 112 which function as diaphragms and the pressure chambers 110.

Figure 5:
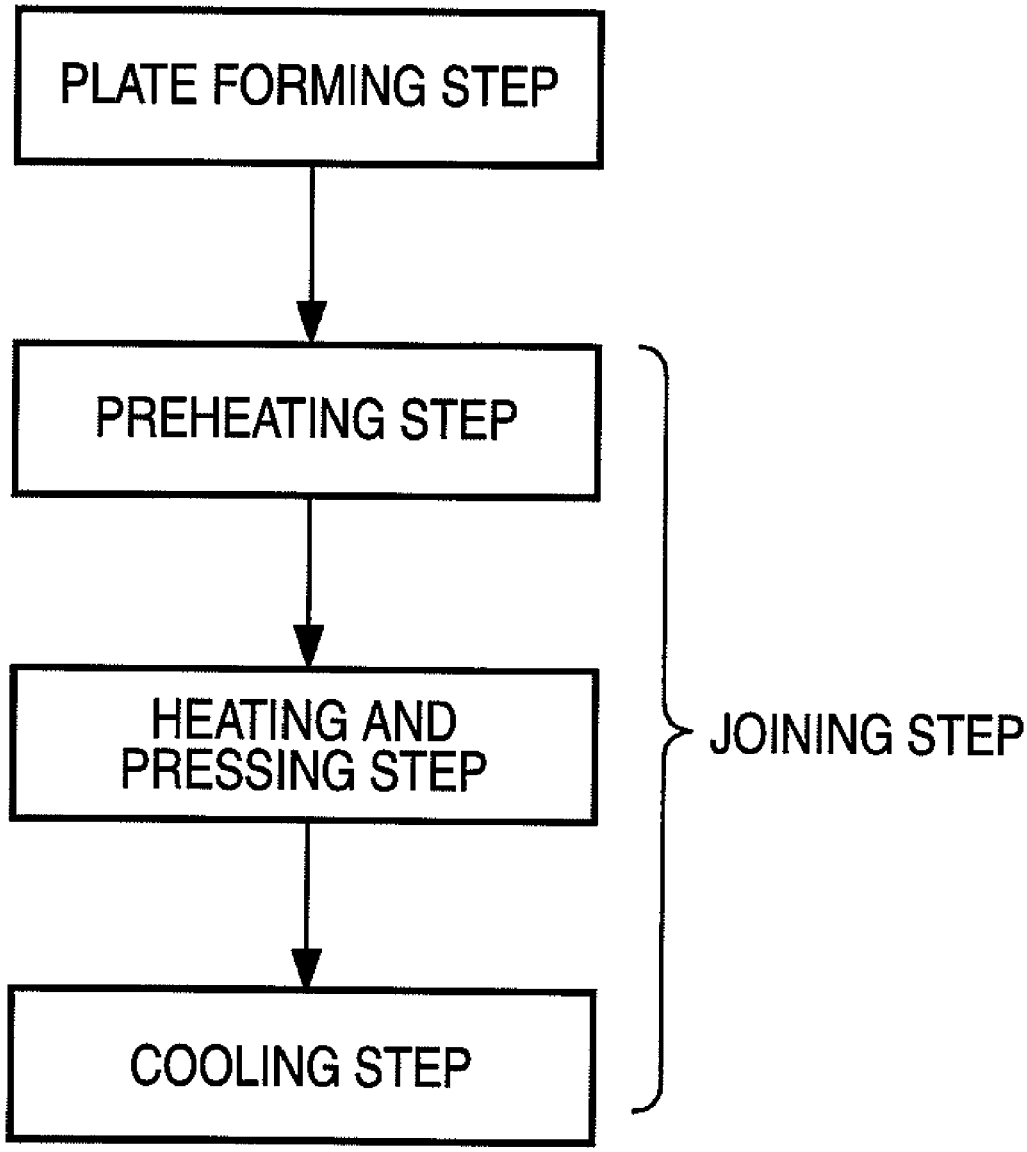
FIG. 5 is a diagram showing a manufacturing process of a flow path unit shown in FIG. 2.

Next, referring to FIG. 5, a manufacturing method of the flow path unit 9 (the ink-jet head 1) will be described. FIG. 5 is a diagram showing a manufacturing process of the flow path unit 9. As shown in FIG. 5, the manufacturing process of the flow path unit 9 includes a plate forming step and a joining step. Firstly, in the plate forming step, nine plates 122 to 129, 131 excluding a damper plate 130 are formed of a SUS 316 stainless steel, and a damper plate 130 is formed of a SUS 430 stainless steel whose coefficient of linear expansion is lower than that of the SUS 316.

The plates 122 to 131 each have a thickness of around 100 μm. In the respective plates 122 to 131, through holes and grooves of predetermined sizes and shapes are formed through etching and pressing methods in accordance with locations where they are located in the flow paths. Of those locations, at portions which define damper chambers 109, recessed portions 130*b* are formed through half-etching so as to be opened towards the nozzle plate 131 side. A bottom wall of the recessed portion 130*b* is made into a thin portion whose thickness ranges from 10 μm to 20 μm (here, about 15 μm). Note that in the event that the thickness of the thin portion becomes 10 μm or thinner, pin holes are produced to thereby generate a leakage of liquid. On the other hand, in the event that the thickness becomes 20 μm or thicker, the damper effect by the damper portion 130*a* becomes weak.

In this exemplary embodiment, the recessed portion 130*b* is formed so as to extend over an overall length of the manifold flow path 105 (including the sub-manifold flow paths 105*a*). The width of the recessed portion 130*b* is equal to the width of the manifold flow path 105 (the sub-manifold flow path 105*a*). In addition, the recessed portion 103*b* is connected to an atmosphere communication hole. By this configuration, a stable damper effect can be obtained regardless of temperature and atmospheric pressure. In addition, from the viewpoint of avoiding the infiltration of ink from the outside, the atmosphere communication hole is formed so as to avoid the other flow paths and is made to open to a surface of the cavity plate 122 in which the pressure chambers 110 are formed. Namely, the plates 122 to 130 hold through holes which configure the atmosphere communication hole by being made to communicate with one another when stacked together, and any of the through holes are formed together with the other through holes by an etching method (in the plate manufacturing step).

Next, in the joining step, the plates 122 to 131 which were formed in the plate forming step are then joined together at one time through metal joining in such a state that the plates are aligned with one another. This joining step is performed in a vacuum which contains an oxidizing gas in several ppm and includes a preheating step, a heating and pressing step and a cooling step. In the preheating step, the plates 122 to 131 which have been stacked together while being aligned with one another are preheated. By this treatment, the respective plates 122 to 131 are thermally expanded. As this occurs, since the damper plate 130 is formed of the SUS 430 whose coefficient of linear expansion is smaller than that of the other plates 122 to 129, 131, the plates 122 to 129, 131 are expanded larger than the damper plate 130.

Then, in the heating and pressing step, the plates 122 to 131 which were preheated in the preheating step are pressed in the stacking direction while being heated further, whereby the plates 122 to 131 are joined together at one time through metal joining. Namely, in such a state that the plates 122 to 129 and 131 are expanded larger than the damper plate 130, the plates 122 to 131 are joined to one another through solid-state reaction.

In the cooling step, the plates 122 to 131 which were joined together through metal joining in the heating and pressing step are cooled down to 20° C. As this occurs, since the plates 122 to 129 and 131 attempt to contract larger than the damper plate 130, the damper portions 130*a* are compressed in a direction in which side walls of the sub-manifold flow paths 105*a* are made to approach each other. By this action, compression stress which follows along the surfaces of the damper portions 130*a* are applied to the damper portions 130*a*. In addition, tensile stress which follows along the surfaces of the damper portions 130*a* is applied to the manifold plate 129 at portions thereof where the side walls of the sub-manifold flow paths 105*a* are defined and which are joined to areas lying adjacent to the damper portions 130*a*. Thus, the flow path unit 9 is completed. In this flow path unit 9, a difference in amount of thermal expansion between the manifold plate 129 and the damper plate 130 resulting at a point in time at which the plates 122 to 131 are joined together through metal joining in the joining step directly configures a magnitude of compression stress generated in the damper portions 130*a*.

Thus, according to the embodiment that has been described heretofore, since the natural frequency f of the damper portions 130*a* is decreased due to stress softening by the application of compression stress to the damper portions 130*a*, the damper effect with respect to the sub-manifold flow paths 105*a* can be enhanced while ensuring the thickness of the damper portions 130*a*.

In addition, since the damper plate 130 is formed of the material whose coefficient of linear expansion is smaller than that of the manifold plate 129 which lies adjacent thereto, compression stress is applied to the damper portions 130*a* by cooling the plates 122 to 131 which were joined together through metal joining in the joining step from the heated state.

Further, in the joining step, the plates 122 to 131 which were preheated to 120° C. in the preheating step and were then preheated further are pressed in the stacking direction while being heated further so as to join the plates 122 to 131 together at one time through metal joining. In this way, since the plates 122 to 131 are all joined together at one time in the stable thermally expanded state, the plates 122 to 131 can be joined together with accuracy. In addition, the plates 122 to 131 can be joined together strongly and rigidly through metal joining.

Furthermore, since the damper chambers 109 whose ceiling walls are configured by the damper portions 130*a* are formed in the flow path unit 9, a stable damper effect can be obtained.

In addition, since all the plates 122 to 131 which configure the flow path unit 9 are made of the metal materials (stainless steels), the strength of the flow path unit 9 can be increased.

First Modified Example

Figure 6:
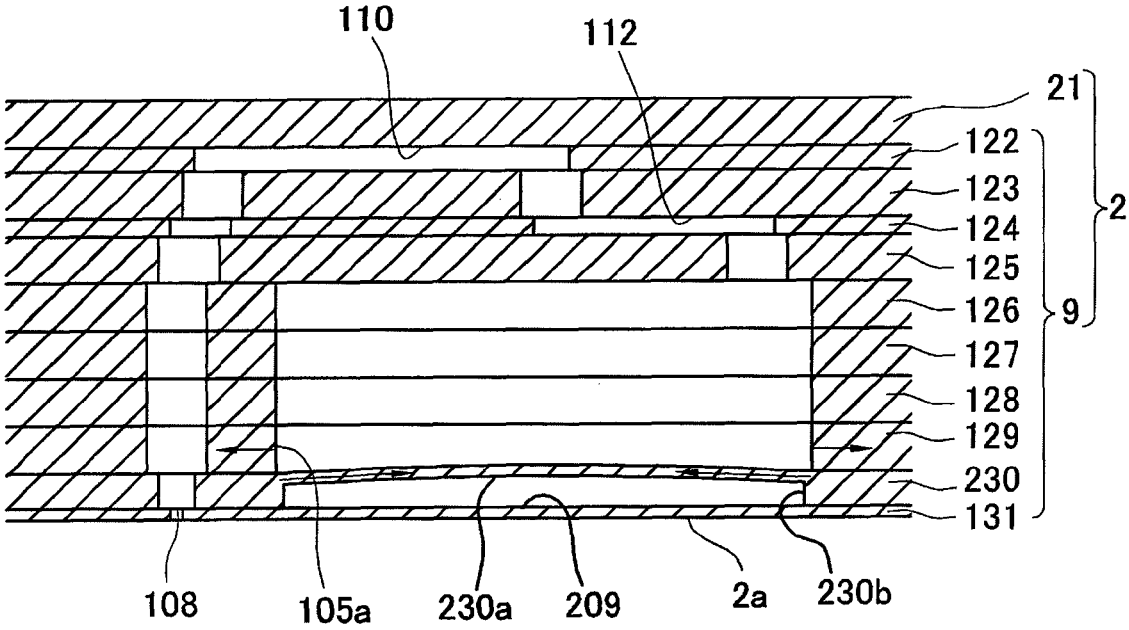
FIG. 6 is a diagram showing a first modified example.

Referring to FIG. 6, a first modified example of the invention will be described. FIG. 6 is a sectional view of a flow path unit 9 according to the first modified example. As shown in FIG. 6, in the flow path unit 9 of the first modified example, the width of a recessed portion 230*b* of a damper plate 230 which defines a damper chamber 209 is made smaller than the width of a sub-manifold flow path 105*a* with respect to an orthogonal direction which is orthogonal to a direction in which the sub-manifold flow path 105*a* extends. In addition, by compression stress which follows along the surface direction of a damper portion 230*a* which is a bottom wall of the sub-manifold flow path 105*a* (a bottom wall of the recessed portion 230*b* formed on the damper plate 230) being applied to the damper portion 230*a* (refer to arrows), the damper portion 230*a* is curved so as to be convex towards the sub-manifold flow path 105*a*. According to this configuration, since a wide space can be ensured within the damper chamber 209, pressure fluctuation in ink within the sub-manifold flow path 105*a* can be suppressed over a wide range.

Second Modified Example

Figure 7:
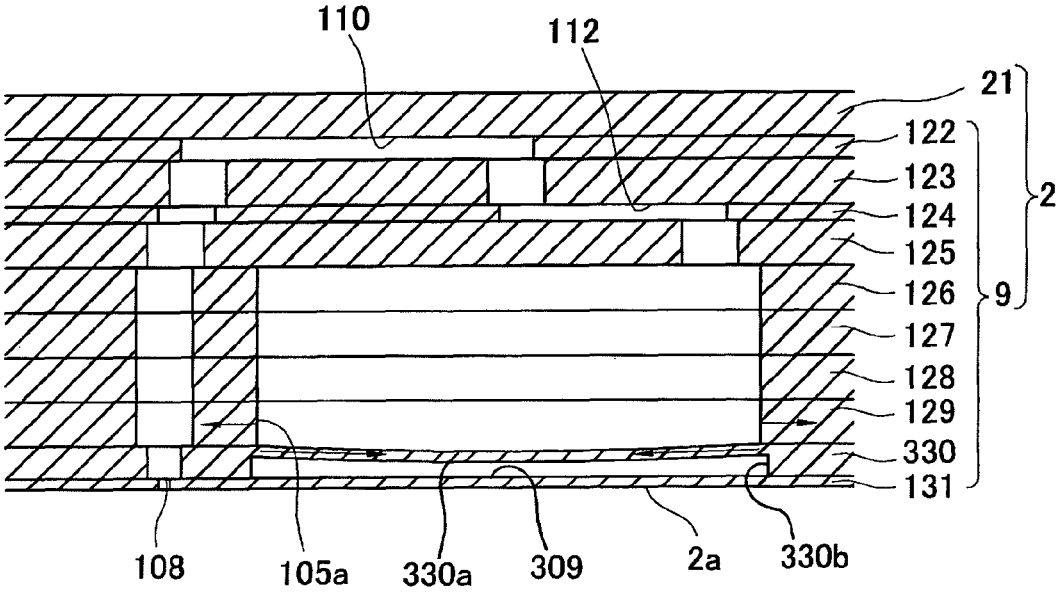
FIG. 7 is a diagram showing a second modified example.

Referring to FIG. 7, a second modified example of the invention will be described. FIG. 7 is a sectional view of a flow path unit according to the second modified example. As is shown in FIG. 7, in the flow path unit 9 according to the second modified example, the width of a recessed portion 330*b* of a damper plate 330 which defines a damper chamber 309 is made larger than the width of a sub-manifold flow path 105*a* with respect to an orthogonal direction which is orthogonal to a direction in which the sub-manifold flow path 105*a* extends. In addition, by compression stress which follows along the surface direction of a damper portion 330*a* which is a bottom wall of the sub-manifold flow path 105*a* (a bottom wall of the recessed portion 330*b* formed on the damper plate 330) being applied to the damper portion 330*a* (refer to arrows), the damper portion 330*a* is curved in such a manner as to be convex towards an inside of the damper chamber 309. According to this configuration, since a large capacity can be ensured for the sub-manifold flow path 105*a*, a supply amount of ink to the individual ink flow path 132 can be increased while ensuring the damper effect.

In the two modified examples, the causes for the curved damper portions 230*a*, 330*a* are common. In the modified examples described above, there exists the difference in width between the damper portions 230*a*, 330*a* and the manifold flow path 105 (the sub-manifold flow path 105*a*) which the damper portions 230*a*, 330*a* confront. When the damper portions 230*a*, 330*a* receive the compression stress applied thereto in the surface direction of the damper portions 230*a*, 330*a*, the damper portions 230*a*, 330*a* attempt to contract in the surface direction and to expand in the direction orthogonal to the surface. The contraction in the surface direction is also the contraction of the other plates. Because of this, in the damper portions 230*a*, 330*a*, a difference in strain is generated between a surface portion and a surface portion opposite thereto in accordance with the difference in width. This difference in strain is the cause for the curved damper portions 230*a*, 330*a*.

Figure 8:
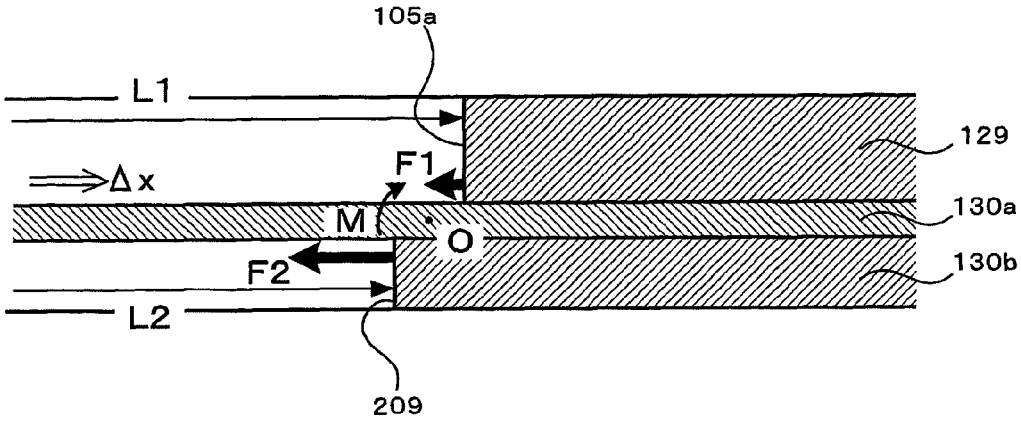
FIG. 8 is a partially enlarge sectional view of an end portion of a damper chamber.

This will be described specifically. FIG. 8 is a partially enlarged sectional view of an end portion of the damper chamber 209. This shows a case where the width L1 of the sub-manifold flow path 105*a* is wider than the width L2 of the damper chamber 209 (L1>L2). In addition, although the damper plate 130 is the single metallic plate having the recessed portions, here, the damper plate 130 is treated as a stacked body made up of two plates 130*a*, 130*b*. Because of this, the plate 130*a* which functions as a damper member is held by the manifold plate 129 and the plate 130*b* at the end portion of the damper chamber 209.

With respect to the width direction of the sub-manifold flow path 105*a*, let's assume that the contraction in the surface direction by the compression stress is Δx. In the plate 130*a*, the strain on the surface facing the sub-manifold flow path side is expressed by $\epsilon 1=\Delta x/L1$, and the strain on the surface facing the damper chamber 209 side is expressed by $\epsilon 2=\Delta x/L2$. Since there exists a relationship of L1>L2 with respect to the widths of the sub-manifold flow path 105*a* and the damper chamber 209, there exists a relationship of $\epsilon 1<\epsilon 2$ with respect to strain. When this relationship is expressed by a relationship in magnitude of stress σ, $\sigma 1<\sigma 2$. As this occurs, at the end portion of the damper chamber 209 (an end portion of a portion of the plate 130*a* where it is held by the plate 129 and the plate 130*b*), a force F1 ($\propto\sigma 1$) is generated in the surface facing the sub-manifold flow path 105*a* and a force F2 ($\propto\sigma 2$) is generated in the surface facing the damper chamber 209. From the relationship of L1>L2, the forces so generated are in a relationship of F1<F2. Assuming that the thickness of the plate 130*a* is t, a rotational moment M=(F2−F1)/t/2) corresponding to the difference in force is generated at the end portion of the damper chamber 209. By this rotational moment, the damper portion 230*a* is deformed in such a manner as to be convex towards the sub-manifold flow path 105*a* side (refer to FIG. 6).

Also in the event that the width L1 of the sub-manifold flow path 105*a* is narrower than the width L2 of the damper chamber 309 (L1<L2), the same explanation as what has been explained above can be adopted, and the damper portion 330*a* is deformed in such a manner as to be convex towards the damper chamber 309 side (refer to FIG. 7).

Thus, while the exemplary embodiment of the invention has been described heretofore, the invention is not limited to the embodiment described above and hence can be modified variously without departing from the spirit and scope thereof. For example, in the embodiment described above, while all the plates 122 to 131 which configure the flow path unit 9 are made to be made of the metal material such as the stainless steels, at least part of the plates 122 to 131 may be made of a metal material other than stainless steel or a material other than metal materials such as resins.

In addition, in the exemplary embodiment, while the coefficient of linear expansion of the damper plate 130 is lower than the coefficient of linear expansion of the manifold plate 129 and the compression stress is made to be applied to the damper portion 130*a* by cooling the plates 122 to 131 which were joined together through metal joining in the joining step from the heated state, for example, a configuration may be adopted in which a different method is used to apply compression stress to the damper portion 130*a* in which the plates 122 to 131 are joined together in such a state that only the damper plate 130 is physically compressed along the surface direction when the plates are joined together. As this occurs, the coefficient of linear expansion of the damper plate 130 may be equal to or larger than the coefficient of linear expansion of the other plates 122 to 129, 131.

Further, in the exemplary embodiment described above, while the plates 122 to 131 are preheated at 120° C. in the preheating step, and thereafter, the plates 122 to 131 which have been so preheated are pressed in the stacking direction while being heated further so that the plates 122 to 131 are joined together through metal joining, the plates 122 to 131 may be made to be joined together through metal joining without going through the preheating step, provided that the plates 122 to 131 are put in a stable thermally expanded state in the pressing and heating step.

In addition, in the exemplary embodiment described above, while the plates 122 to 131 are made to be joined together at one time in the joining step, a configuration may be adopted in which the plates 122 to 131 are joined together step by step.

Further, in the exemplary embodiment described above, while the plates 122 to 131 are made to be joined together through metal joining in the heating and pressing step, a configuration may be adopted in which the plates 122 to 131 are joined together with a thermosetting adhesive. By adopting this configuration, the plates 122 to 131 can be joined together inexpensively.

Figure 9:
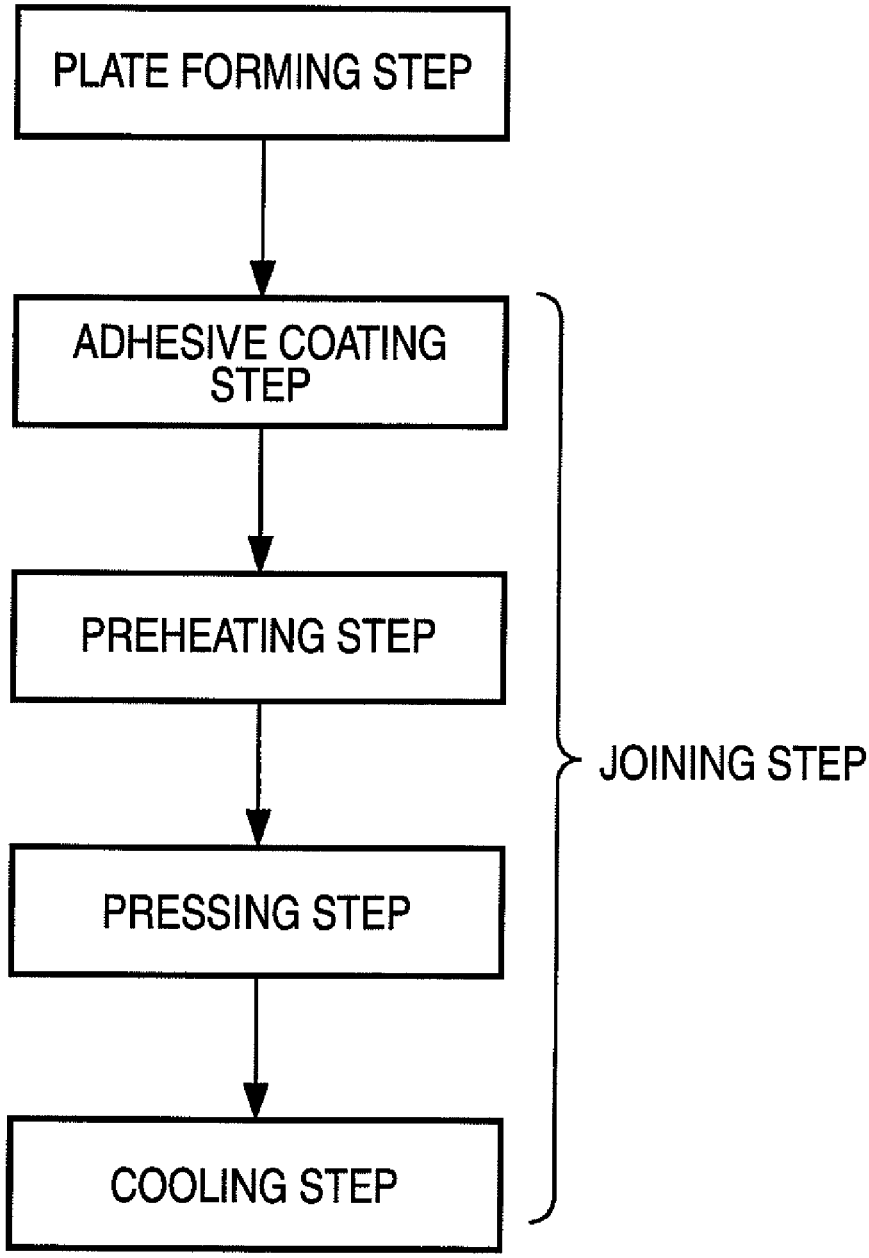
FIG. 9 is a diagram showing a flow path unit manufacturing process using an adhesive, which is a further modified example.

A manufacturing method employing a thermosetting adhesive will briefly be described. FIG. 9 is a diagram showing a manufacturing process of the flow path unit 9 using an adhesive. As shown in FIG. 9, a manufacturing process of the flow path unit 9 includes a plate forming step and a joining step as in the exemplary embodiment described above. Of these steps, the plate forming step is the same as that of the exemplary embodiment.

Here, the joining step will be described. In the joining step, an adhesive coating step is performed in which an adhesive is coated to adhesion surfaces of plates 122 to 131 which were obtained in the plate forming step. As this occurs, no adhesive is coated to the nozzle plate 131. An epoxy-based thermosetting adhesive whose thermosetting temperature is on the order of 80° C. is used and is coated uniformly using a bar coater.

Next, the plates 122 to 130 to which the adhesive has been applied are stacked sequentially on the nozzle plate 131 while being aligned with one another. Further, this stacked body is placed on a lower jig of a heating and pressing apparatus. The lower jig is heated in advance to 120° C. together with an upper jig which confronts the lower jig. A slight gap is defined between the stacked body and the upper jig, and this state is maintained for about 2 minutes. During this period of time, the temperature of the stacked body placed on the lower jig is increased. As the temperature of the stacked body increases, in the adhesive, the viscosity drops once and then turns to start to increase. The temperature of the stacked body reaches 120° C. before the adhesive sets, and the respective plates 122 to 121 complete their own thermal expansion at this temperature without interfering with each other (preheating step).

At a point in time at which about two minutes have elapsed since the stacked body was started to be heated (was placed on the lower jig), a pressing step is performed in which the lower jig and the upper jig press hold and heat the stacked body while applying pressure thereto. The temperature of the stacked body is held at 120° C. during the pressing step. The pressing step is carried out until the adhesive sets completely. In this exemplary embodiment, it is on the order of four minutes.

Thereafter, the stacked body is released from the held state by the upper and lower jigs, and a cooling step is carried out in which the stacked body is cooled down to the normal or room temperatures. Thus, when the procedure is completed in the way described above, the manufacturing of the flow path unit 9 using the adhesive is completed.

In this manufacturing method, the respective plates 122 to 131 expand to their maximum extent at the predetermined temperature in such a state that the adhesive is applied thereto. At this timing, the plates 122 to 131 are subjected to the pressing step and wait for the adhesive to set, during which the respective plates 122 to 131 are fixed in place as they have expanded to their maximum extent at the predetermined temperature. In the cooling step which takes place after the adhesive has set, although the respective plates 122 to 131 attempt to contract, a difference in contraction amount is generated between the plate 129 and the plate 130 in accordance with the difference in thermal expansion coefficient. By this difference in contraction amount so generated, compression stress along the surface direction comes to be imparted to the damper portions in the damper plate 130.

Figure 10A:
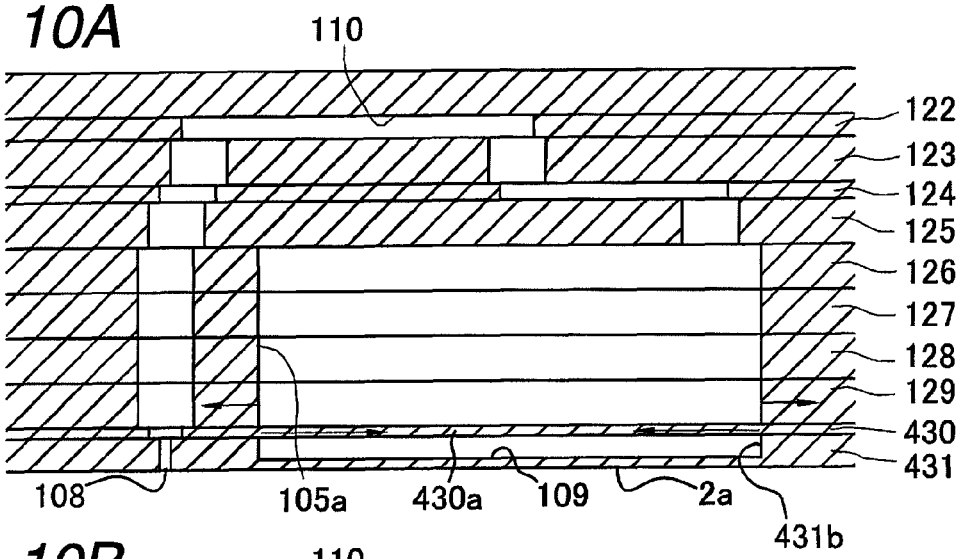
FIG. 10A, FIG. 10B and FIG. 10C are drawings showing other modified examples.

In the exemplary embodiment described above, while the recessed portions 130*b* opened towards the nozzle plate 131 are formed in the damper plate 130 to thereby define the damper chambers 109 by the recessed portions 130*b* and the nozzle plate 131, as shown in FIG. 10A, a configuration may be adopted in which a damper plate 430, which lies adjacent to a manifold plate 129 and configures a bottom wall of a sub-manifold flow path 105*a*, has a thin plate shape, a recessed portion 431*b* is formed in a nozzle plate 431 which lies adjacent to a lower side of the damper plate 430 so as to be opened towards the damper plate 430, and a damper chamber 409 is defined by the recessed portion 431*b* and a damper portion 430*a* which configures an area of the damper plate 430 which confronts the sub-manifold flow path 105*a*. In addition, as this occurs, compression stress following along the surface direction of the damper portion 430*a* is applied to the damper portion 430*a*.

Figure 10B:
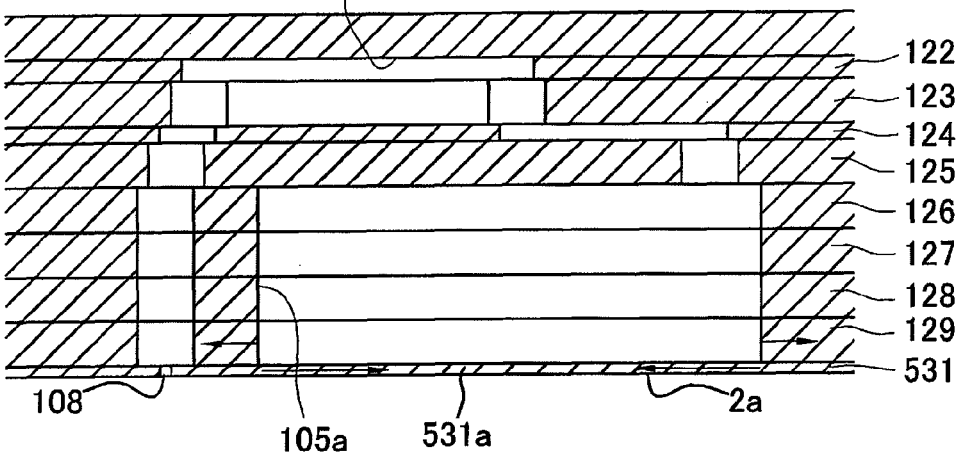

In addition, as shown in FIG. 10B, a configuration may be adopted in which a nozzle plate 531, which lies adjacent to a lower side of a manifold plate 129 and configures a bottom wall of a sub-manifold flow path 105*a* and in which a nozzle 108 is formed, has a thin plate shape. In addition, the coefficient of linear expansion of the nozzle plate 531 is made smaller than the coefficient of linear expansion of other plates 122 to 129. Additionally, an area of the nozzle plate 531 which confronts the sub-manifold flow path 105*a* configures a damper portion 531*a*, and compression stress following the surface direction of the damper portion 531*a* is applied to the damper portion 531*a*. Namely, the nozzle plate 531 doubles as a damper plate. By this configuration, since the damper effect can be obtained without forming a damper chamber in the flow path unit, a reduction in size of the ink-jet head 1 can be realized.

Figure 10C:
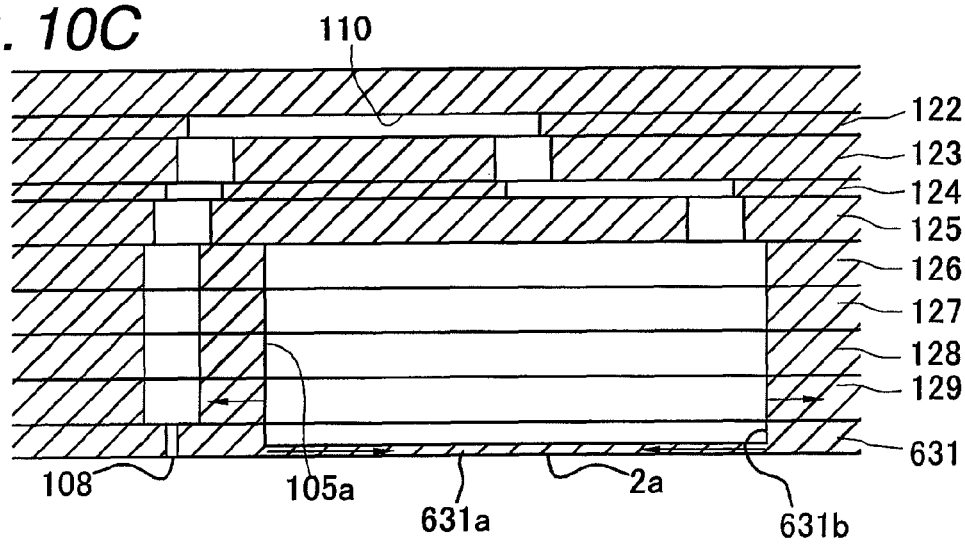

In addition, from the viewpoint of ensuring a sub-manifold flow path 105*a* having a wide capacity, as shown in FIG. 10C, a configuration may be adopted in which a nozzle plate 631, which lies adjacent to a lower side of a manifold plate 129 and in which a nozzle 108 is formed, has a recessed portion 631*b* which is opened towards the manifold plate 129, the recessed portion 631*b* defines part of the sub-manifold flow path 105*a*, and a bottom wall of the recessed portion 631*b* configures a damper portion 631*a*.

As described above, according to the exemplary embodiment of the invention, there is provided a liquid discharging head including a flow path unit in which common liquid flow paths for supplying liquid to nozzles which discharge liquid droplets are formed by a plurality of plates being stacked together, the plurality of plates including a damper plate of which one surface defines at least parts of side wall surfaces of the common liquid flow paths and areas on the other surface which confront the common liquid flow paths are not in contact with any of the plurality of plates, wherein compression stress along the side wall surfaces are applied to areas on the damper plate which configure side walls of the common liquid flow paths.

According to the exemplary embodiment of the present invention, since when the compression stress is applied to the areas of the damper plate which confront the common liquid flow paths, the natural frequency of the areas is decreased due to stress softening, the damper effect with respect to the common liquid flow paths can be increased while ensuring the thickness of the areas of the damper plate which confront the common liquid flow paths.

In the exemplary embodiment, the damper plate is preferably made of a material having a smaller coefficient of linear expansion than those of the plates which lie adjacent thereto. According to this configuration, since the damper plate is made of the material having the smaller coefficient of linear expansion than those of the other plates, when the damper plate and the other plates joined thereto are cooled from the heated state in so joining the damper plate, by the other plates which lie adjacent to the damper plate attempting to contract more largely than the damper plate, compression stress is applied to the areas of the damper plate which confront the common liquid flow paths.

Additionally, in the exemplary embodiment, recessed portions which confront the common liquid flow paths may be formed on the opposite surface of the damper plate to the side thereof which face the common liquid flow paths, and one of the plurality of plates may lie adjacent to the damper plate in such a manner as to seal the recessed portions. According to this configuration, since the spaces are defined which lie adjacent to the common liquid flow paths via the damper plate, a stable damper effect can be obtained.

As this occurs, the recessed portion may extend along the common liquid flow path, the width of the recessed portion may be smaller than the width of the common liquid flow path with respect to an orthogonal direction which is orthogonal to a direction in which the recessed portion extends, and a bottom wall of the recessed portion may be curved to be convex towards the common liquid flow path side. According to this configuration, since a wide space can be ensured within the recessed portion, the pressure fluctuation of liquid within the common liquid flow path can be suppressed over a wide range.

In addition, the recessed portion may extend along the common liquid flow path, the width of the recessed portion may be larger than the width of the common liquid flow path with respect to an orthogonal direction which is orthogonal to a direction in which the recessed portion extends, and a bottom wall of the recessed portion may be curved to be convex towards an opposite side to the common liquid flow path side. According to this configuration, since a wide space can be ensured within the recessed portion, the supply amount of liquid can be increased while ensuring the damper effect.

In the exemplary embodiment, the damper plate may double as a nozzle plate in which the nozzles are formed. According to this configuration, a reduction in size of the liquid droplet discharge head can be realized.

In addition, the plates are preferably made of a metallic material. According to this configuration, the strength of the liquid droplet discharge head can be increased.

According to another aspect of the exemplary embodiment, there is provided a liquid discharging head manufacturing method for manufacturing a liquid droplet discharge head which includes a flow path unit in which common liquid flow paths for supplying liquid to nozzles which discharge liquid droplets are formed by a plurality of plates made of a metallic material being stacked together, the plurality of plates including a damper plate of which one surface defines at least parts of side wall surfaces of the common liquid flow paths and areas on the other surface which confront the common liquid flow paths are not in contact with any of the other plates, including a plate forming step of forming the plurality of plates, and a joining step of joining the plates which lie adjacent to each other in such a state that the plates are heated, wherein in the plate forming step, the damper plate is formed of a metallic material having a coefficient of linear expansion along the side wall surface which is smaller than those of the plates which lie adjacent thereto.

According to this another aspect, since the damper plate is made of the material having the smaller coefficient of linear expansion than the other plates, in the joining step, when the damper plate and the other plates joined thereto are cooled from the heated state, by the other plates joined thereto attempting to contract more largely than the damper plate, compression stress is applied to the areas of the damper plate which confront the common liquid flow paths. Because of this, since the natural frequency of the areas in question is decreased due to stress softening, the damper effect with respect to the common liquid flow paths can be enhanced while ensuring the thickness f the areas of the damper plate which confront the common liquid flow paths.

According to the above another aspect, in the plate forming step, the damper plate is preferably formed of a metallic material of which the coefficient of linear expansion is smaller than those of all the other plates. According to this configuration, compression stress is applied to the areas of the damper plate which confront the common liquid flow paths with good efficiency.

In addition, in the above another aspect, in the joining step, the plates which lie adjacent to each other may be metal joined together. According to this configuration, the plates can be joined together strongly and rigidly.

Additionally, in the joining step, the plates which lie adjacent to each other are preferably joined together with a thermosetting adhesive. According to this configuration, the plates can be joined together in an inexpensive fashion.

According to the above another aspect, in the joining step, the plates which lie adjacent to each other are preferably heated at a predetermined temperature, and thereafter, a pressure is preferably applied to the plates so heated in a stacking direction of the plates. According to this configuration, since the plates to be joined together are joined together in a stable thermally expanded state, the plates can be joined together accurately.

In addition, according to the above another aspect, in the joining step, all the plates are preferably joined together at one time. According to this configuration, all the plates can be joined together further accurately.

As described above, according to the aspects of the exemplary embodiment, when compression stress is applied to the areas of the damper plates which confront the common liquid flow paths, since the natural frequency of the areas in question is decreased due to stress softening, the damper effect with respect to the common liquid flow paths can be enhanced while ensuring the thickness of the rears of the damper plates which confront the common liquid flow paths.

What is claimed is:

1. A liquid discharging head comprising:

a plurality of plates and a damper plate stacked together, in which a common liquid flow path for supplying liquid to a nozzle which discharges liquid is formed, wherein the damper plate comprises a first surface that defines at least a part of a wall surface of the common liquid flow path and a second surface which is opposed to the common liquid flow path across the damper plate and which is not in contact with the plurality of plates, wherein a natural frequency of the damper plate is decreased by a compression stress applied to a portion of the damper plate in a direction perpendicular to a stacking direction of the plurality of plates, and wherein the damper plate is made of a material having a smaller coefficient of linear expansion than that of the plate which is adjacent to the damper plate.

2. The liquid discharging head according to claim 1, wherein a recess portion which is opposed to the common liquid flow path across the damper plate is formed on the second surface of the damper plate, and wherein one of the plurality of plates is adjacent to the damper plate so as to seal the recess portion.

3. The liquid discharging head according to claim 1, wherein the plurality of plates are made of a metallic material.

4. The liquid discharging head according to claim 1, wherein the damper plate doubles as a nozzle plate in which the nozzle is formed.

5. The liquid discharging head according to claim 2, wherein the recess portion extends along the common liquid flow path, and wherein a width of the recess portion is smaller than a width of the common liquid flow path in a direction perpendicular to an extending direction in which the recess portion extends, and a bottom wall of the recess portion is curved to be convex towards the common liquid flow path.

6. The liquid discharging head according to claim 2, wherein the recess portion extends along the common liquid flow path, and wherein a width of the recess portion is larger than a width of the common liquid flow path in a direction perpendicular to an extending direction in which the recess portion extends, and a bottom wall of the recess portion is curved to be convex towards an opposite side to the common liquid flow path.

7. A liquid discharging head comprising:

a plurality of plates and a damper plate; and a common liquid flow path which is formed by the plurality of plates and the damper plate being stacked together, and which is configured to supply liquid to a nozzle that discharges liquid, wherein the damper plate comprises a portion to which compression stress is applied in a direction perpendicular to a stacking direction of the plurality of plates so as to decrease a natural frequency of the damper plate, the portion including:

a first surface portion that defines at least a part of a wall surface of the common liquid flow path; and a second surface portion which is opposite side of the first surface portion and which is not in contact with the plurality of plates, wherein the damper plate is made of a material having a smaller coefficient of linear expansion than that of the plate which is adjacent to the damper plate.

8. The liquid discharging head according to claim 7, wherein a recess portion, which includes the second surface portion, is formed on the damper plate.

* * * * *